US010199744B2

(12) United States Patent
Park

(10) Patent No.: US 10,199,744 B2
(45) Date of Patent: Feb. 5, 2019

(54) DIRECTIONAL MIMO ANTENNA USING ELECTRO-POLARIZATION

(71) Applicant: SAWWAVE CO., LTD., Busan (KR)

(72) Inventor: Jeong-suk Park, Busan (KR)

(73) Assignee: SAWWAVE CO., LTD., Busan (KR)

( * ) Notice: Subject to any disclaimer, the term of this patent is extended or adjusted under 35 U.S.C. 154(b) by 0 days.

(21) Appl. No.: 15/503,346

(22) PCT Filed: Mar. 27, 2015

(86) PCT No.: PCT/KR2015/003037

§ 371 (c)(1),
(2) Date: Feb. 10, 2017

(87) PCT Pub. No.: WO2016/056715

PCT Pub. Date: Apr. 14, 2016

(65) Prior Publication Data

US 2017/0237179 A1 Aug. 17, 2017

(30) Foreign Application Priority Data

Oct. 7, 2014 (KR) ..... 10-2014-0135102

(51) Int. Cl.

| | |
|---|---|
| ***H01Q 21/06*** | (2006.01) |
| ***H01Q 21/24*** | (2006.01) |
| ***H01Q 1/38*** | (2006.01) |
| ***H01Q 9/04*** | (2006.01) |

(52) U.S. Cl.
CPC ..... *H01Q 21/065* (2013.01); *H01Q 1/38* (2013.01); *H01Q 9/045* (2013.01); *H01Q 21/24* (2013.01)

(58) Field of Classification Search
CPC ..... H01Q 21/24; H01Q 1/38; H01Q 21/065
See application file for complete search history.

(56) References Cited

FOREIGN PATENT DOCUMENTS

| | | | |
|---|---|---|---|
| EP | 0 936 693 | | 11/2002 |
| EP | 2 270 924 | | 1/2011 |
| JP | 2010041700 | | 2/2010 |
| KR | 1020050029008 | | 3/2005 |
| KR | 1020080035555 | | 4/2008 |
| KR | 1020090057350 | | 6/2009 |
| KR | 1020080035555 | * | 2/2011 |
| KR | 1020120026760 | | 3/2012 |

* cited by examiner

*Primary Examiner* — Graham Smith
(74) *Attorney, Agent, or Firm* — IP & T Group LLP

(57) ABSTRACT

A directional MIMO antenna using electro-polarization is provided to realize a MIMO antenna capable of maintaining directivity utilizing an antenna using electro-polarization formed by disposing a metal strip antenna on a circuit board. The directional MIMO antenna includes a horizontal polarization line formed by disposing a plurality of horizontal polarization strips for generating horizontal polarization on one surface of a circuit board, a vertical polarization line formed by disposing a plurality of vertical polarization strips for generating vertical polarization on the other surface of the circuit board to correspond to a position of the horizontal polarization line, and a radiation antenna connected to the horizontal polarization line and the vertical polarization line.

4 Claims, 9 Drawing Sheets

DIRECTIONAL MIMO ANTENNA USING ELECTRO-POLARIZATION

This application is a national stage application of PCT/KR2015/003037 filed on Mar. 27, 2015, which claims priority of Korean patent application number 10-2014-0135102 filed on Oct. 7, 2014. The disclosure of each of the foregoing applications is incorporated herein by reference in its entirety.

TECHNICAL FIELD

The present disclosure relates to a directional multiple input multiple output (MIMO) antenna using electro-polarization, and more particularly, to a MIMO antenna capable of maintaining directivity utilizing an antenna using electro-polarization formed by disposing a metal strip antenna on a circuit board.

BACKGROUND ART

In general, in communications circuits, a plurality of high frequency signals are combined as one signal or bound as one to thereby establish communications means such as multiband systems via connection with other circuits.

When the plurality of signals are connected and used on one line, problems in which the signals are offset from one another or loss thereof is caused due to division thereof, depending on respective signal characteristics may occur.

Thus, peculiar antennas for each signal have been used or filters for filtering noise or the like have been installed, such that there have been negative attributes such as a complex structure, an increase in a size of a circuit, and the like.

Thus, the present applicant has proposed a method for controlling a current to only flow in a desired direction by controlling a high frequency signal current to flow in a predetermined direction on a metal plate using electro-polarization, and an antenna using the same, in Korean Patent No. 10-1017690 (Electro-polarization and Application thereof, hereinafter, referred to as 'the related art'). Here, in the related art, when a high frequency signal is divided into a positive (+) signal and a negative (−) signal according to a polarity and two signals are applied to a metal plate, two signals are applied thereto to be connected to each other while maintaining a predetermined time interval therebetween. Thus, an effect that an application direction of the current is constant so as to allow the current to constantly flow only in a current application direction along an axis at which the current is applied may be obtained. Here, a combiner combining a plurality of signals with each other so as to provide the plurality of signals as one signal, using the effect as described above, or the like, is used, so that respective input signals may not be transferred to different input ports, but may only be transferred to an output port, thereby providing a technology in which the combiner is used as a combination circuit having excellent isolation between input ports and loss due to a signal combination is prevented.

Although the antenna technology of application thereof, according to the related art described above, in which the structure thereof is simplified and the effect thereof is excellent, has been provided, the development of a directional multiple-input multiple-output (MIMO) antenna in which more effective transmission and reception may be obtained by maintaining directivity in which a relatively large amount of transmission is maintained without signal offset, has also been required. Further, a technology for implementation thereof with a simplified structure has been required.

Related Art Documents are as follows.

European Patent Application No. 98102456.5 (Filed Aug. 18, 1999)

European Patent Application No. 10168363.9 (Filed Jan. 5, 2011)

Korean Patent Laid-Open Publication No. 10-2009-0057350 (Published Jun. 5, 2009)

DISCLOSURE

Technical Problem

An aspect of the present disclosure may provide a directional MIMO antenna using electro-polarization, having a simplified structure and high performance.

Technical Solution

According to an aspect of the present disclosure, in a MIMO antenna maintaining directivity using a radiation pattern among radiation antennas using electro-polarization, a directional multiple input multiple output (MIMO) antenna using electro-polarization may include a horizontal polarization line formed by disposing a plurality of horizontal polarization strips for generating horizontal polarization on one surface of a circuit board, a vertical polarization line formed by disposing a plurality of vertical polarization strips for generating vertical polarization on the other surface of the circuit board to correspond to a position of the horizontal polarization line, and a radiation antenna connected to the horizontal polarization line and the vertical polarization line.

In the horizontal polarization line, the horizontal polarization strips may be formed using microstrips disposed such that a direction in which a pair of nodes are spaced apart from each other is a horizontal direction, a plurality of the horizontal polarization strips may be disposed on the circuit board, the horizontal polarization strips may be connected to one another, and then, at a distal end thereof, a first power application port for application of signal power to generate horizontal polarization may be disposed to be located on a central portion of the horizontal polarization line, and first node holes may be formed to penetrate through the circuit board so as to be adjacent to the pair of nodes. A first through hole terminal may further be disposed adjacently to the first power application port of the horizontal polarization line.

In the vertical polarization line, the vertical polarization strips may be formed using microstrips disposed such that a direction in which a pair of nodes are spaced apart from each other is a vertical direction, a plurality of the vertical polarization strips may be disposed on the circuit board, the vertical polarization strips may be connected to one another, and then, at a distal end thereof, a second power application port for application of signal power to generate vertical polarization may be disposed to be located on a central portion of the vertical polarization line, and second node holes may be formed to penetrate through the circuit board so as to be adjacent to the pair of nodes. The horizontal polarization strip and the vertical polarization strip respectively formed on the horizontal polarization line and the vertical polarization line may be connected to each other, and thus, the radiation antenna in charge of transmitting and receiving a signal may radiate a signal applied to the horizontal polarization line and the vertical polarization line by a first lead pin connected to the nodes of the horizontal polarization strip and a second lead pin penetrating through the circuit board to be connected to the nodes of the vertical polarization strip.

Advantageous Effects

According to an exemplary embodiment of the present disclosure, a directional MIMO antenna using electro-polarization with a simplified structure to be facilitated in the manufacturing thereof and high performance may be provided.

MODE FOR INVENTION

Hereinafter, a directional MIMO antenna according to exemplary embodiments of the present disclosure will be described in detail with reference to the accompanying drawings. The disclosure may, however, be exemplified in many different forms and should not be construed as being limited to the specific embodiments set forth herein.

Figure 1:
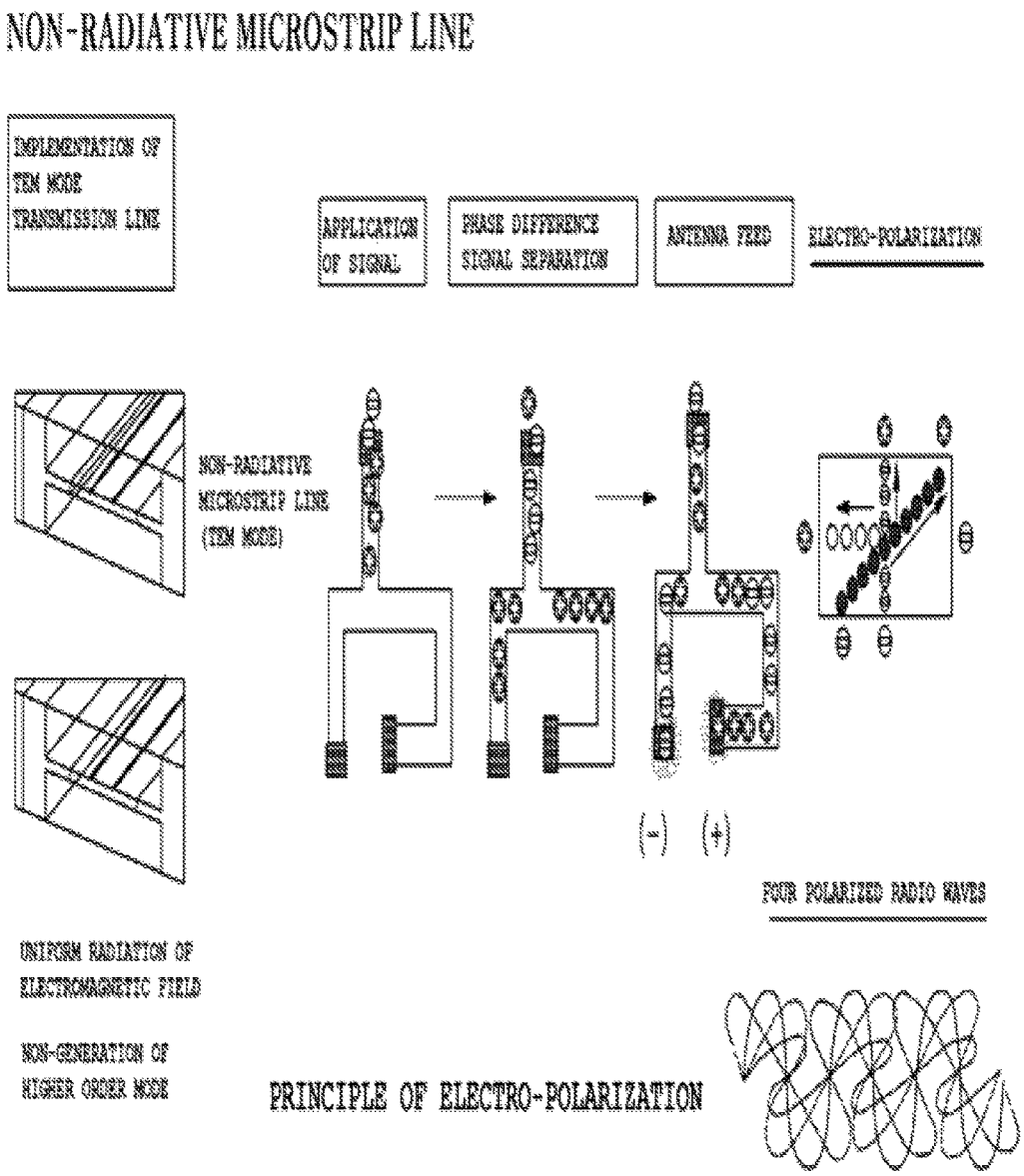
FIG. 1 is a schematic view illustrating electro-polarization according to an exemplary embodiment of the present disclosure.

FIG. 1 is a schematic view illustrating electro-polarization according to an exemplary embodiment of the present disclosure.

Briefly describing electro-polarization with reference to FIG. 1, when a signal is applied to a microstrip implemented on a circuit board, a '+' signal and a '−' signal of the applied signal may be separated from each other according to a phase difference, and power feed to an antenna may be performed in response to the separated signals, thereby generating electro-polarization.

Such electro-polarization may be obtained by configuring an input port, a T distributor distributing a signal, and a 180 degree signal phase shifter via a metal stripline on a dielectric circuit board, and using a metal plate serving as a radiator of a patch antenna so as to generate electro-polarization.

In order to generate the electro-polarization, a pair of polarized strips may be respectively disposed in an x axis and a y axis on a single substrate to exhibit an antenna effect.

Since the technology as described above is a technology commonly known in the art as disclosed in Korean Patent No. 10-1017690 (Electro-Polarization and Application Thereof), a detailed description thereof will be omitted.

Hereinafter, a directional MIMO antenna using the electro-polarization as described above will be described in further detail.

Figure 2:
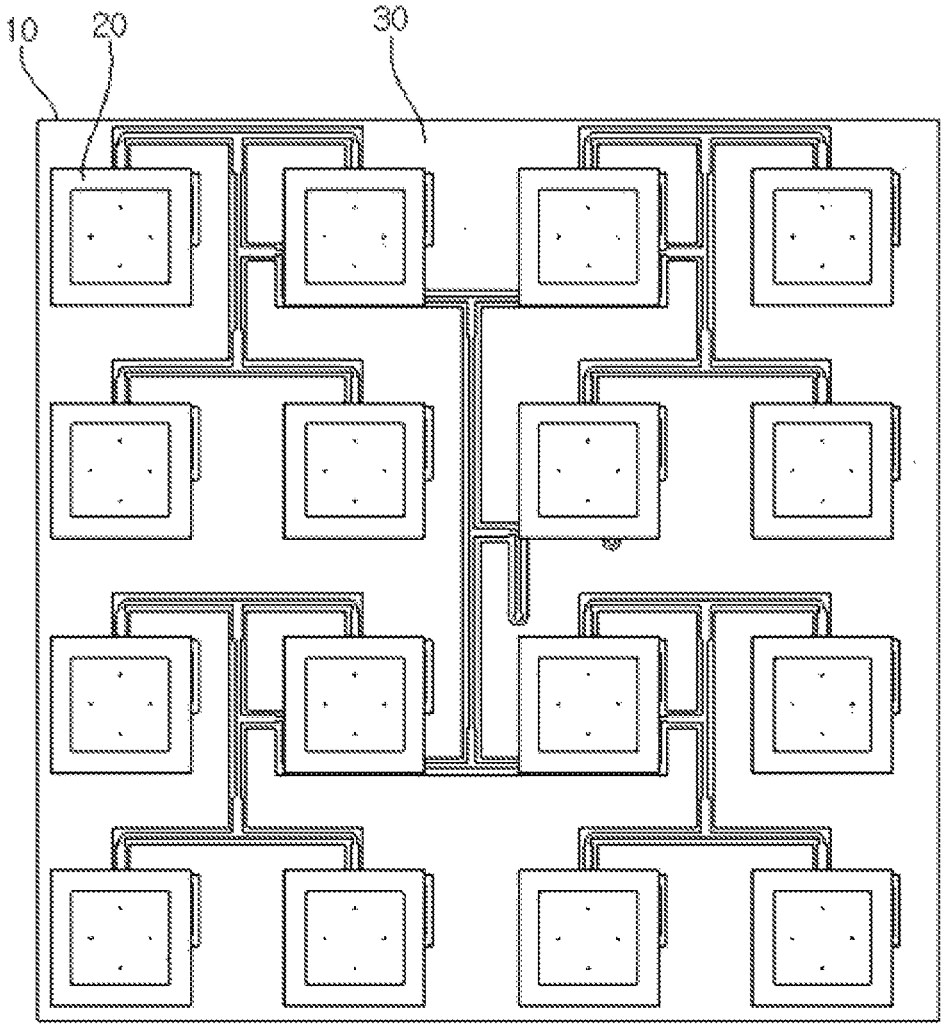
FIG. 2 is a front view according to an exemplary embodiment of the present disclosure.
Figure 3:
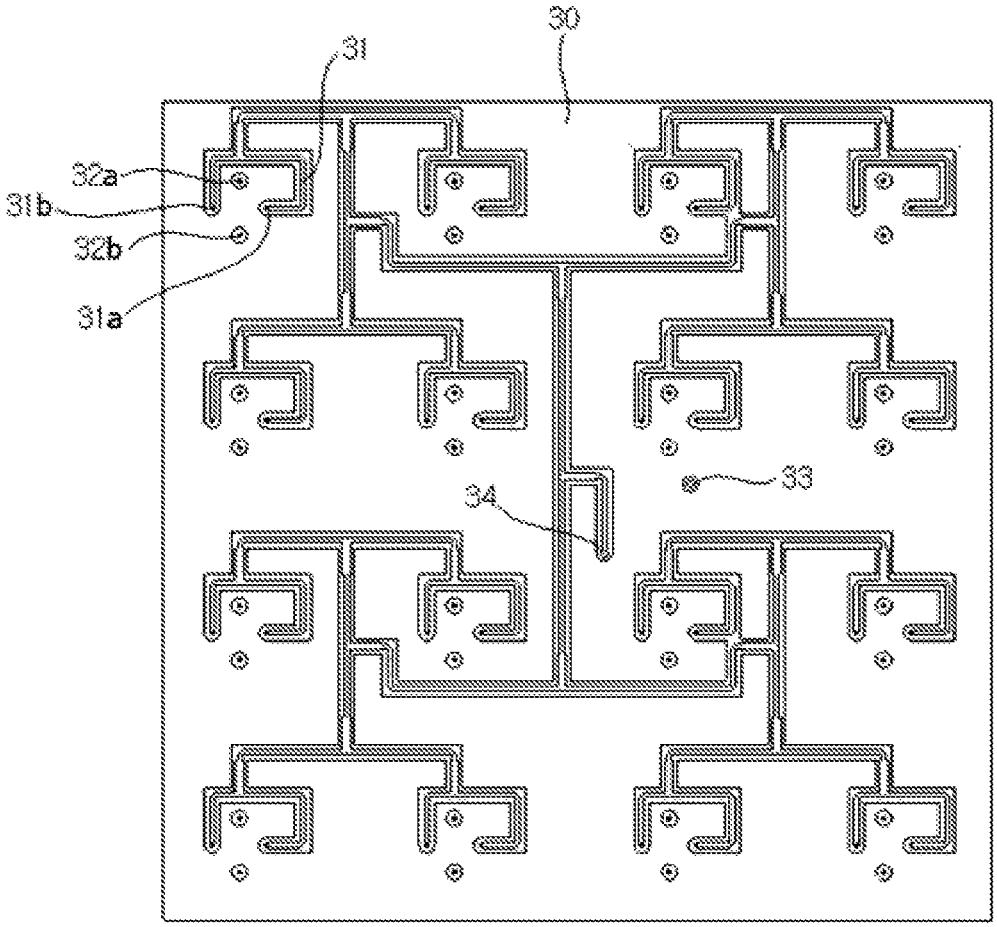
FIG. 3 is a front-line view according to an exemplary embodiment of the present disclosure.
Figure 4:
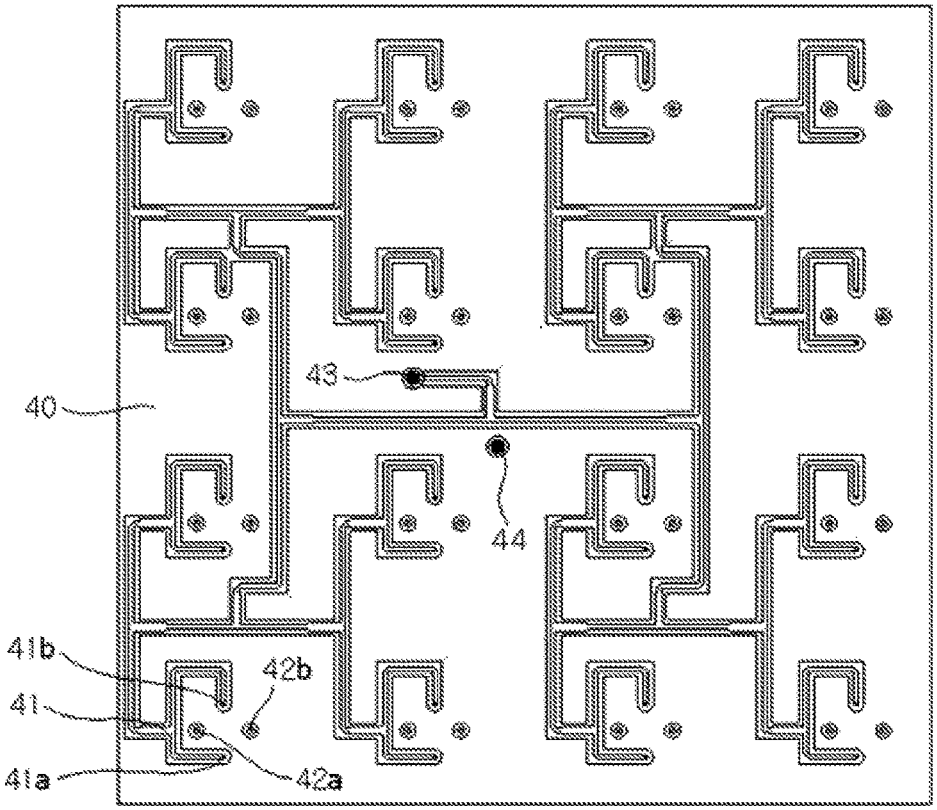
FIG. 4 is a rear-line view according to an exemplary embodiment of the present disclosure.
Figure 5:
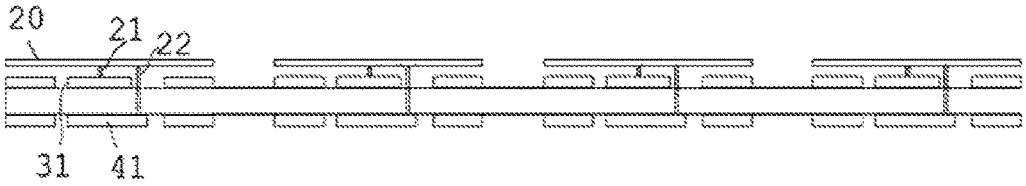
FIG. 5 is a side view illustrating a structure according to an exemplary embodiment of the present disclosure.

FIG. 2 is a front view according to an exemplary embodiment of the present disclosure, FIG. 3 is a front-line view according to an exemplary embodiment of the present disclosure, FIG. 4 is a rear-line view according to an exemplary embodiment of the present disclosure, and FIG. 5 is a side view illustrating a structure according to an exemplary embodiment of the present disclosure.

With reference to FIGS. 2 to 5, polarization lines may be respectively formed on both surfaces of a circuit board by disposing a plurality of microstrip lines for generating polarization on the circuit board, and radiation antennas may be combined with one sides of the polarization lines.

In detail, a directional MIMO antenna according to an exemplary embodiment of the present disclosure may include a horizontal polarization line 30, a vertical polarization line 40, and a radiation antenna 20. The horizontal polarization line 30 may be formed by disposing a plurality of horizontal polarization strips 31 for generating horizontal polarization on one surface of a circuit board 10, and the vertical polarization line 40 may be formed by disposing a plurality of vertical polarization strips 41 for generating vertical polarization on the other surface of the circuit board 10 so as to correspond to a position of the horizontal polarization line 30. In addition, the radiation antenna 20 may be connected to the horizontal polarization line 30 and the vertical polarization line 40.

The circuit board 10 may be a general printed circuit board (PCB). As the circuit board 10, any circuit board in which a circuit using microstrips, for example, lines are able to be implemented using an etching method, a printing method, or the like, may be used.

The horizontal polarization line 30 formed on one surface of the circuit board 10 may be formed by disposing a plurality of horizontal polarization strips 31 to generate polarization in a horizontal direction using microstrips able to exhibit electro-polarization and then connecting the horizontal polarization strips 31 to one another.

Here, the horizontal polarization strip 31 may be formed such that a pair of nodes 31*a* and 31*b* may be horizontally disposed.

The nodes 31*a* and 31*b* may be connected to a first lead pin 21 of the radiation antenna 20.

In addition, first node holes 32*a* and 32*b* may be formed adjacently to the nodes 31*a* and 31*b* in the board, may be disposed to correspond to nodes 41*a* and 41*b* of the vertical polarization line 40 formed on a rear surface of the circuit board 10, and may be formed to penetrate through the circuit board 10.

The reason for the formation of the first node holes 32*a* and 32*b* is that a second lead pin 22 of the radiation antenna 20 is to be inwardly inserted and connected to the vertical polarization strip 41.

Further, a first power application port 34 allowing signal power to be applied to the horizontal polarization line 30 may be disposed on a central portion of the horizontal polarization line 30, and a first through hole terminal 33 may be formed to be adjacent to the first power application port 34.

The first through hole terminal 33 as described above may penetrate through the circuit board 10 so as to be connected to a second power application port 43 of the vertical polarization line 40 formed on the other surface of the circuit board.

On the other surface of the circuit board, opposing one surface of the circuit board on which the horizontal polarization line 30 is formed as described above, the vertical polarization line 40 may be formed by disposing a plurality of vertical polarization strips 41 using microstrips disposed to be able to generate polarization in a vertical direction and then by connecting the vertical polarization strips 41 to one another, so as to correspond to a position of the horizontal polarization line 30.

Here, the vertical polarization strip 41 may be formed in a manner in which a microstrip having the same shape as that of the horizontal polarization strip 31 is rotated by 90 degrees, so as to generate polarization in the vertical direction.

A plurality of the vertical polarization strips 41 formed as above may be disposed to correspond to the positions of the horizontal polarization strips 31 that are disposed to oppose the vertical polarization strips 41.

In further detail, the nodes 41*a* and 41*b* of the vertical polarization strips 41 may be disposed to correspond to the first node holes 32*a* and 32*b* of the horizontal polarization strips 31, respectively.

Further, second node holes 42*a* and 42*b* disposed to be adjacent to the nodes 41*a* and 41*b* of the vertical polarization strip 41 may be formed to penetrate through the circuit board 10 so as to correspond to the positions of the nodes 31*a* and 31*b* of the horizontal polarization strip 31, respectively.

Here, the first lead pin 21 of the radiation antenna 20 may also be insertedly coupled thereto.

Further, the second power application port 43 for application of signal power to generate vertical polarization may be disposed on a central portion of the vertical polarization line 40, and a second through hole terminal 44 may be formed to be adjacent to the second power application port 43.

As described above, the horizontal polarization line 30 and the vertical polarization line 40 may be formed on a front surface and a rear surface of a single circuit board 10, respectively, and when signal power is applied thereto, signals radiated by the plurality of horizontal polarization strips 31 and the plurality of vertical polarization strips 41 may be radiated through the radiation antennas 20.

A plurality of the signals radiated by the directional MIMO antenna using electro-polarization as described above may have directivity maintained by the radiation antennas 20.

Figure 6:
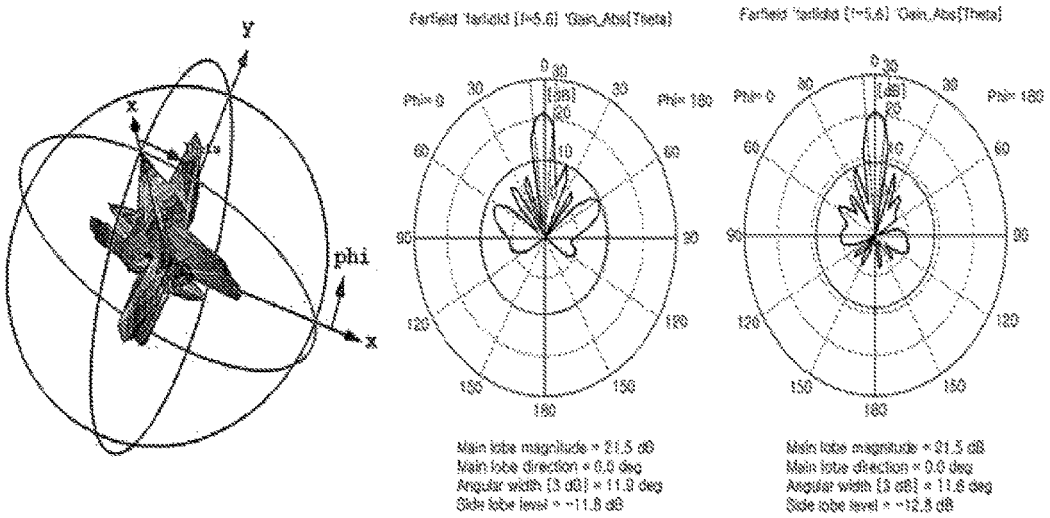
FIG. 6 is a diagram illustrating radiation patterns of a directional MIMO antenna using electro-polarization according to an exemplary embodiment of the present disclosure.
Figure 7:
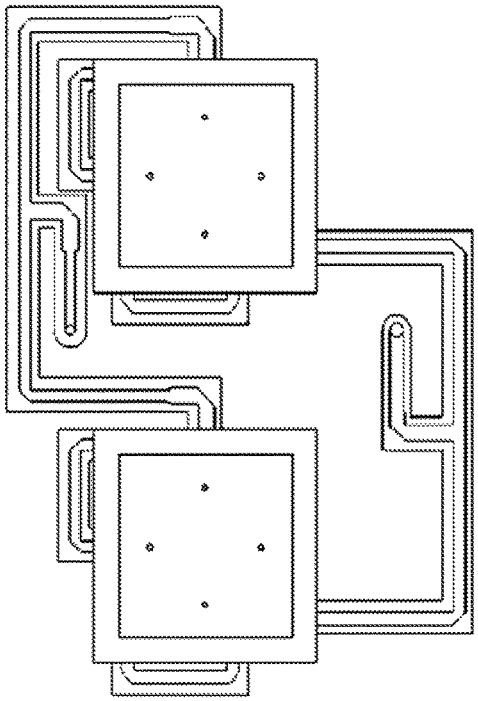
FIGS. 7 to 11 are diagrams illustrating examples of antennas to which various patterns are applied according to exemplary embodiments of the present disclosure.
Figure 8:
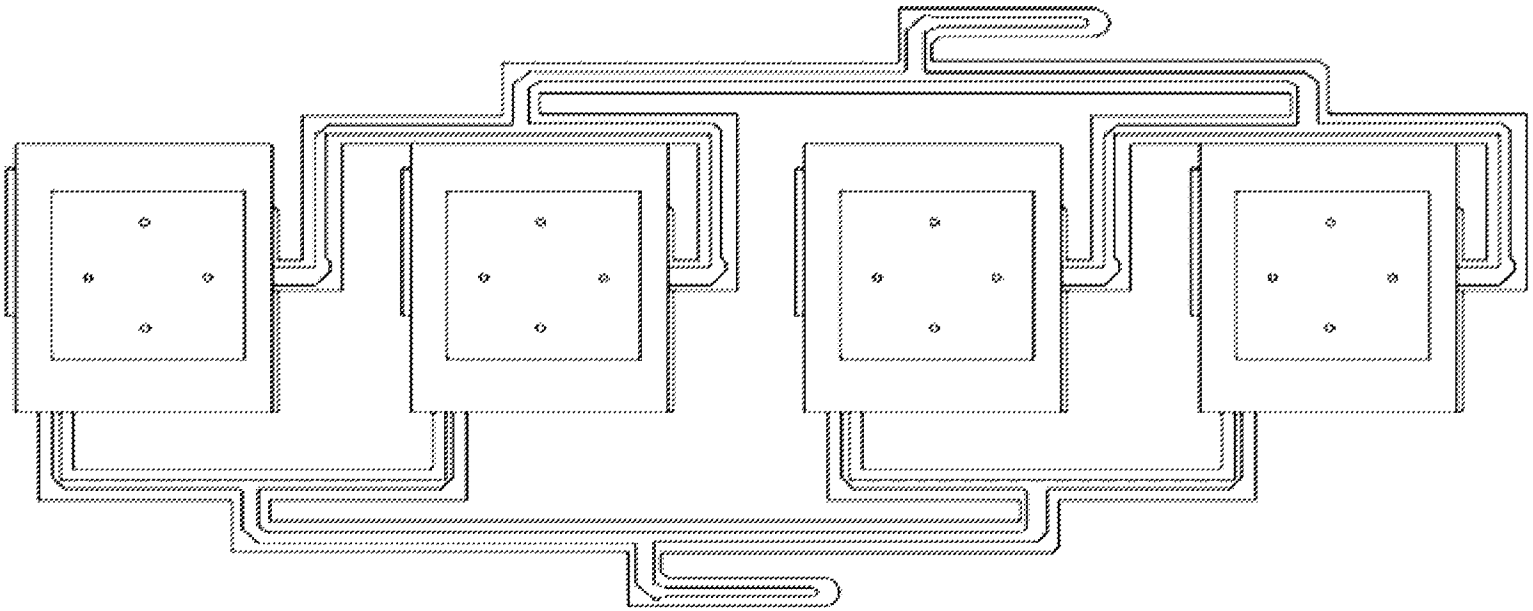
Figure 9:
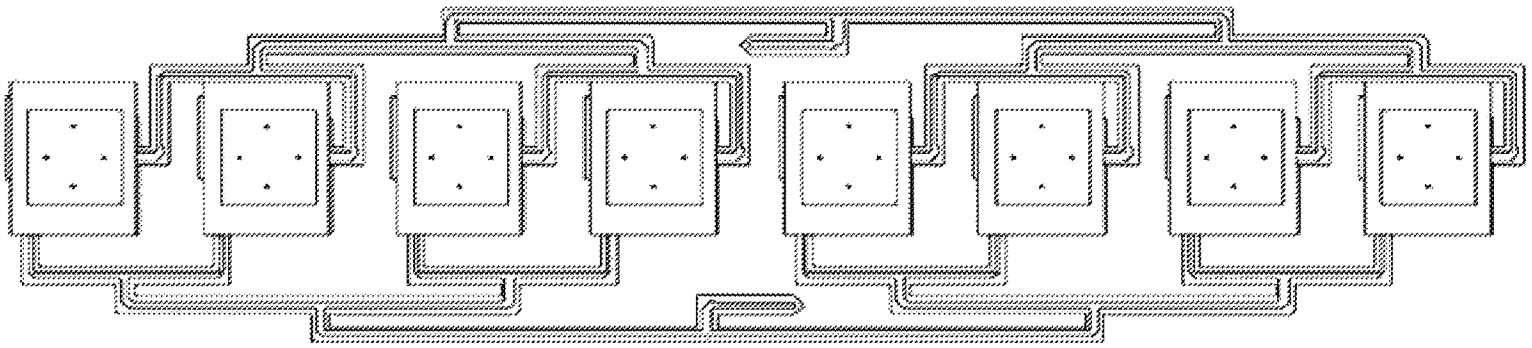
Figure 10:
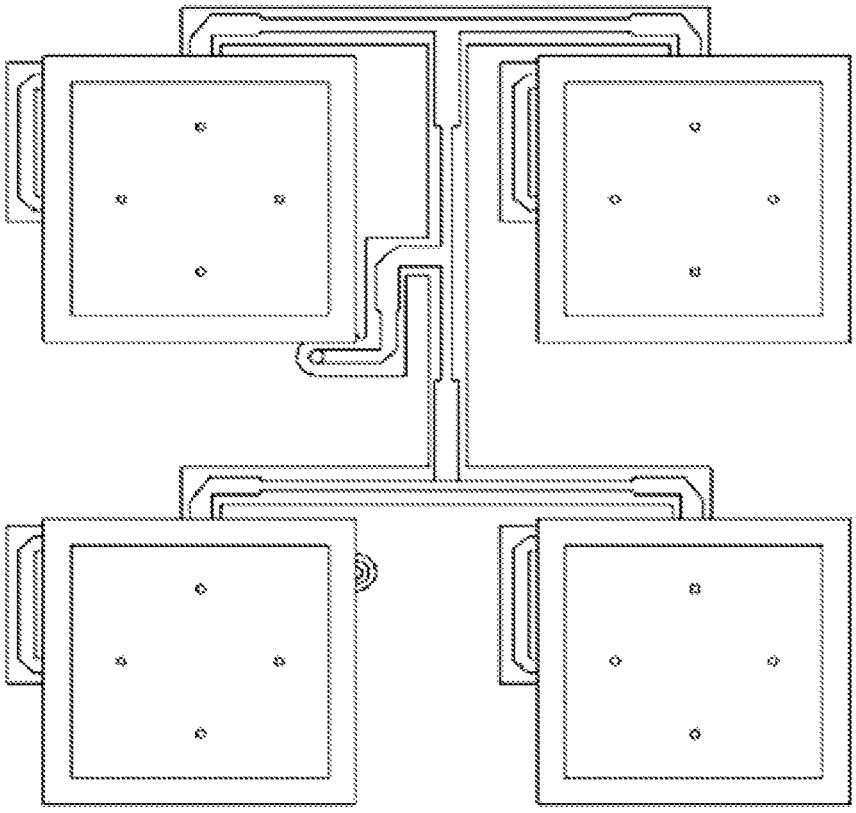
Figure 11:
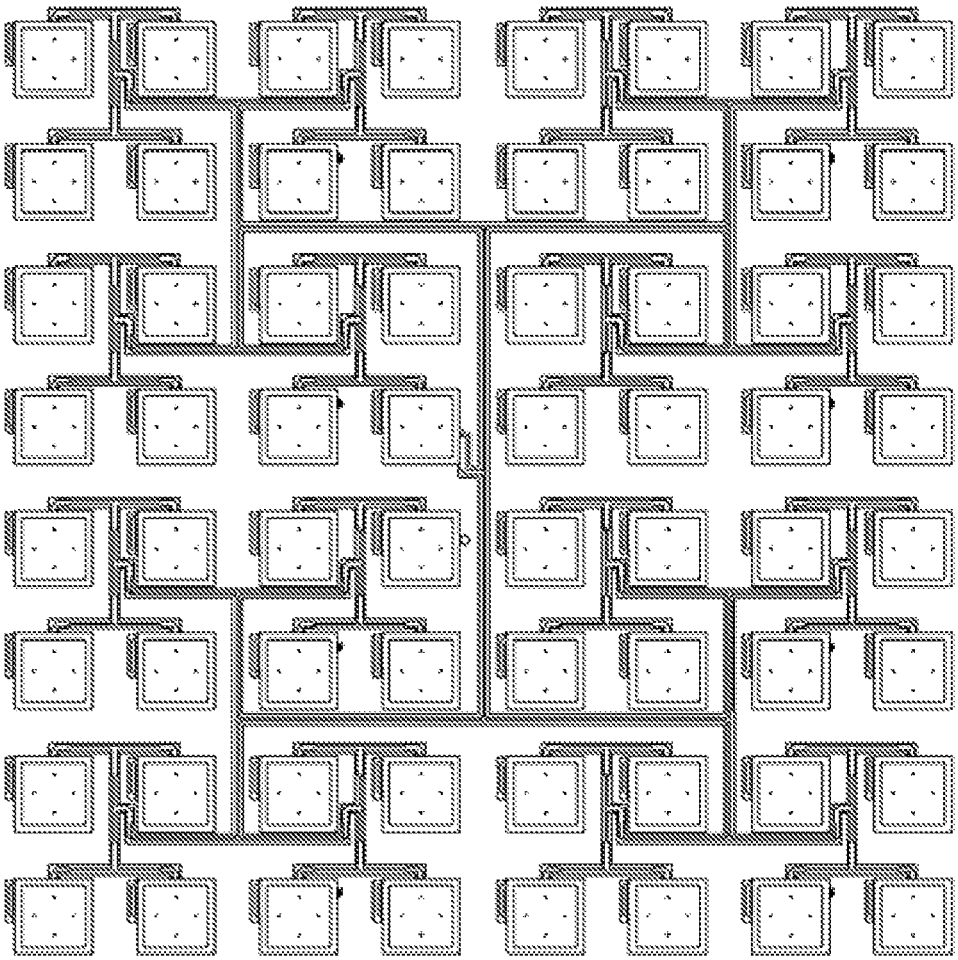

In this regard, referring to FIG. 6 illustrating a radiation pattern of the directional MIMO antenna using electro-polarization of the present disclosure, it can be appreciated that the signal is radiated to be biased in a specific direction such that the directivity thereof may be maintained.

In addition, although the example of a 4×4 matrix model has been described for a detailed description of the present disclosure by way of example, the present disclosure is not limited thereto. Thus, various patterns may be applied thereto as illustrated in FIGS. 7 to 11.

The application of various patterns as described above may be carried out depending on the number and range of signals applied thereto.

As described above, a directional MIMO antenna using electro-polarization according to an exemplary embodiment of the present disclosure may be provided.

While exemplary embodiments have been shown and described above, it will be apparent to those skilled in the art that modifications and variations could be made without departing from the scope of the present invention as defined by the appended claims.

DESCRIPTION OF REFERENCE NUMERALS

10: Circuit Board
20: Radiation Antenna
21: First Lead Pin
22: Second Lead Pin
30: Horizontal Polarization Line
31: Horizontal Polarization Strip
31*a*, 31*b*: Node
32*a*, 32*b*: First Node Hole
33: First Through Hole Terminal
34: First Power Application Terminal
40: Vertical Polarization Line
41: Vertical Polarization Strip
41*a*, 41*b*: Node
42*a*, 42*b*: Second Node Hole
43: Second Power Application Port
44: Second Through Hole Terminal

The invention claimed is:

1. A directional multiple input multiple output (MIMO) antenna using electro-polarization, in a MIMO antenna maintaining directivity using a radiation pattern among radiation antennas using the electro-polarization, the directional MIMO antenna comprising:

a horizontal polarization line formed by disposing a plurality of horizontal polarization strips for generating horizontal polarization on one surface of a circuit board;

a vertical polarization line formed by disposing a plurality of vertical polarization strips for generating vertical polarization on the other surface of the circuit board to correspond to a position of the horizontal polarization line; and a radiation antenna connected to the horizontal polarization line and the vertical polarization line, wherein the horizontal polarization strip and the vertical polarization strip respectively formed on the horizontal polarization line and the vertical polarization line are connected to each other, and thus, the radiation antenna being in charge of transmitting and receiving a signal radiates a signal applied to the horizontal polarization line and the vertical polarization line by a first lead pin connected to a pair of nodes of the horizontal polarization strip and a second lead pin penetrating through the circuit board to be connected to a pair of nodes of the vertical polarization strip.

2. The directional MIMO antenna of claim 1, wherein the horizontal polarization line is characterized in that the horizontal polarization strips are formed using microstrips disposed such that a direction in which the pair of nodes are spaced apart from each other is a horizontal direction, a plurality of the horizontal polarization strips are disposed on the circuit board, the horizontal polarization strips are connected to one another, and then, at a distal end thereof, a first power application port for application of signal power to generate horizontal polarization is disposed to be located on a central portion of the horizontal polarization line, and first node holes are formed to penetrate through the circuit board so as to be adjacent to the pair of nodes.

3. The directional MIMO antenna of claim 2, further comprising a first through hole terminal disposed adjacently to the first power application port of the horizontal polarization line.

4. The directional MIMO antenna of claim 1, wherein the vertical polarization line is characterized in that the vertical polarization strips are formed using microstrips disposed such that a direction in which the pair of nodes are spaced apart from each other is a vertical direction, a plurality of the vertical polarization strips are disposed on the circuit board, the vertical polarization strips are connected to one another, and then, at a distal end thereof, a second power application port for application of signal power to generate vertical polarization is disposed to be located on a central portion of the vertical polarization line, and second node holes are formed to penetrate through the circuit board so as to be adjacent to the pair of nodes.

* * * * *